United States Patent [19]

Christenbery

[11] 4,422,197

[45] Dec. 27, 1983

[54] WORKPIECE TRANSPORTING MECHANISM

[75] Inventor: Frederick L. Christenbery, Derry, N.H.

[73] Assignee: International Shoe Machine Corporation, Nashua, N.H.

[21] Appl. No.: 375,508

[22] Filed: May 5, 1982

[51] Int. Cl.[3] ..... A43D 21/00

[52] U.S. Cl. ..... 12/1 A

[58] Field of Search ..... 12/1 A, 1 R

[56] References Cited

U.S. PATENT DOCUMENTS 3,147,500 9/1964 Ralphs ..... 12/1 A 4,296,514 10/1981 Dokoupil et al. ..... 12/1 A

*Primary Examiner*—Patrick D. Lawson

[57] ABSTRACT

A mechanism for so transporting an insole (118) rearwardly between a pair of molds (122,124) that regardless of the length of the insole the ball portion of the insole is in registry with the ball portions of the molds. This is accomplished by a mechanism that moves gauges (36,54) at different speeds against opposite ends of the insole to locate the insole on a support (52,58) and then transports the insole on the support a prescribed distance rearwardly between the molds. This invention provides the improvement of an adjusting arrangement for adjusting the ratios of the speeds at which the gauges are moved against the opposite ends of the insole.

3 Claims, 7 Drawing Figures

WORKPIECE TRANSPORTING MECHANISM

BACKGROUND OF THE INVENTION

U.S. patent application Ser. No. 262,665 filed May 11, 1981 discloses a mechanism for so transporting a flat workpiece (an insole) to a work station (an insole molding station) that a prescribed portion (the ball portion) of the insole is in registry with a prescribed portion (the ball portions of molds) of the work station. This is accomplished by providing: a front gauge mounted to a carrier for forward-rearward movement; a back gauge, located rearwardly of the front gauge, mounted for forward-rearward movement; a work support mounted to the front gauge and extending rearwardly towards the back gauge; gauge moving means for moving the front gauge rearwardly with respect to the carrier and the back gauge forwardly at different speeds until the gauges intersect the opposite ends of the workpiece that is on the support; means, operative after the intersection of the gauges with the opposite ends of the workpiece, to lock the front gauge to the carrier and to hold the workpiece on the work support; and means for thereafter transporting the carrier rearwardly a prescribed distance to thereby transport the workpiece to the work station with said prescribed portions in registry.

The workpieces are herein disclosed to be flat insoles and the work station is disclosed to be a molding station having a pair of molds with complementary molding surfaces that move towards each other with insole therebetween to mold or shape the flat insole to the shape of the molding surfaces. In such a molding operation, it is desirable that the ball portion of the insole be located between and be in registry with the ball portions of the molding surfaces prior to imparting closing movements of the molds with respect to the insole to cause the molding surfaces to mold the insole.

Insoles of different lengths are so constituted that there is a greater change in distances from one insole length to another between the ball portions and the heel ends of the insoles than there is between the ball portions and the toe ends of the insoles and it is for this reason that the front gauge moves rearwardly and the back gauge moves forwardly at different speeds.

SUMMARY OF THE INVENTION

For each of women's insoles, children's insoles, and men's insoles, the ratios of the changes in distances for different lengths of insoles between the ball portions and the heel ends and between the ball portions and the toe ends is substantially a constant. However, these ratios are different for women's insoles, children's insoles, and men's insoles. In order to take into account these different ratios in women's, children's and men's insoles, the mechanism of application Ser. No. 262,665 has been improved, in accordance with this invention, by providing adjusting means for adjusting the ratios at which the gauge moving means move the front gauge rearwardly and the back gauge forwardly.

While, in the illustrative embodiment of the invention, the workpiece is disclosed as being an insole and the work station is disclosed as being a pair of cooperative molds, the invention, in its broadest aspects, is not limited to such a workpiece and such a work station. For example, it is within the purview of this invention for the workpiece to be marked in a particular location and the work station to be a coating implement that applies the mark.

DESCRIPTION OF THE PREFERRED EMBODIMENT

Figure 1:
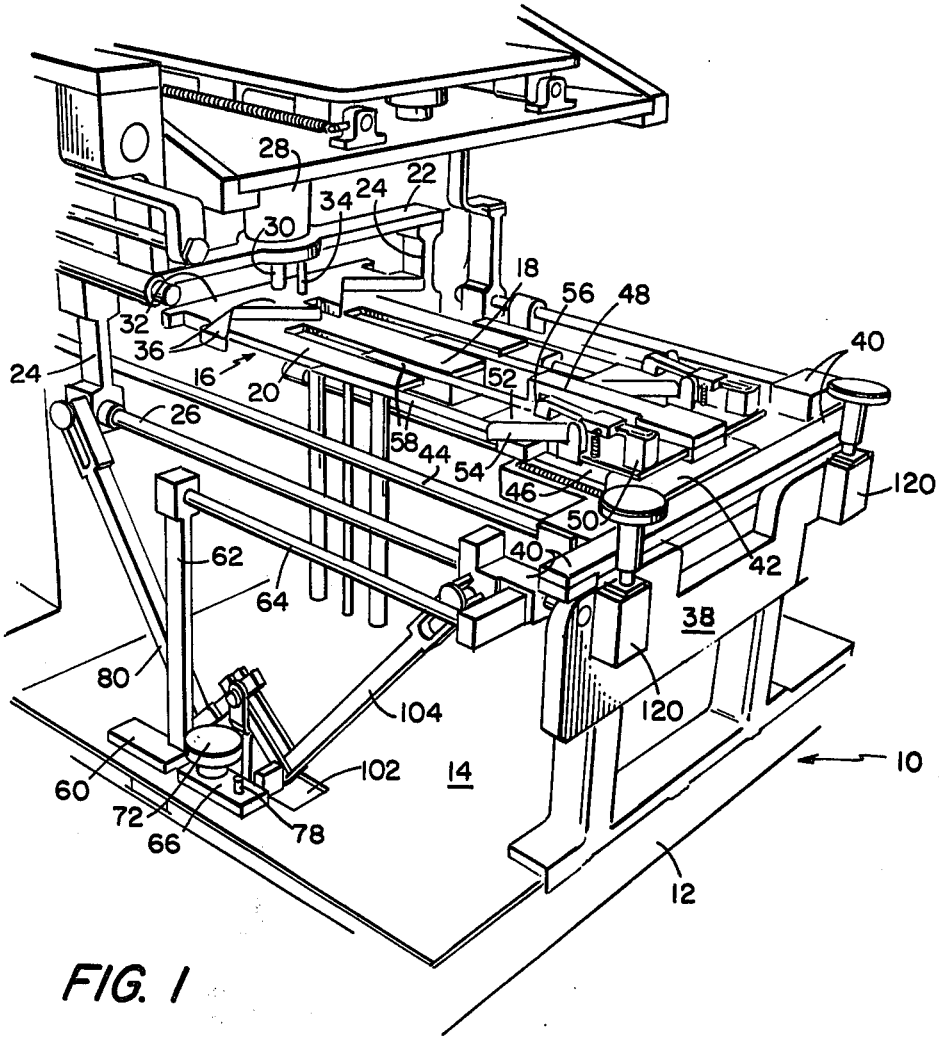
FIG. 1 is an isometric view of the front portion of a machine incorporating the invention.

Referring to FIG. 1, the machine comprises a frame 10 having an end 12. The end 12 is intended to face the operator during the machine operation. The parts of the machine closest to the operator will be considered to be the front of the machine and the parts of the machine furthermost from the operator will be considered to be the back of the machine. Movements of machine elements toward the operator will be considered to be "forward" movements and movements of machine elements away from the operator will be considered to be "rearward" movements.

The machine is intended to operate on a left foot shoe assembly and a right foot shoe assembly. The machine therefore has two sets of mechanisms for operating on the shoe assemblies which are duplicates of each other apart from variations needed to accommodate one set of mechanisms for the left foot shoe assembly and the other set of mechanisms for the right foot shoe assembly. Therefore, in the following description, it is to be understood that, while reference is made to one mechanism, this mechanism is duplicated in the machine.

As shown in FIG. 1, a table 14 is located at the front of the frame 10. A platform 16, comprising laterally spaced and forwardly extending central finger 18 and side finger 20, is mounted for heightwise movement and is heightwise movable in the manner shown in patent application Ser. No. 262,665.

A back carriage 22 is mounted by lugs 24 on guide bars 26 for forward-rearward movement. A pneumatic motor 28, mounted to the carriage 22, has a downwardly directed piston rod 30 that is connected to a back gauge block 32. A pin 34, connected to and extending upwardly of the back gauge block 32 through the carriage 22, guides the back gauge block 32 for vertical movement pursuant to actuations of the motor 28. A forwardly facing V-shaped back gauge 36 is formed on the gauge block 32 and is located above the platform 16.

The fronts of the guide bars 26 are mounted to a fixed plate 38 at the front of the machine above the table 14. A frame 40 is mounted for forward-rearward sliding movement on the guide bars 26 and is located rearwardly of the plate 38. A carrier 42, located rearwardly of the frame 40, is slidably mounted for forward-rearward movement on guide bars 44. In the manner shown in patent application Ser, No. 262,665, a sub-carrier 46 is mounted to the carrier 42 for forward-rearward movement and is yieldably urged forwardly to a position of engagement of the front of the sub-carrier 46 with the back of the frame 40. Also as shown in patent application Ser. No. 262,665, a front gauge block 48 is mounted to the sub-carrier 46.

The front gauge block 48 is formed of a wing 50 that includes a rearwardly extending plate 52 and a rearwardly facing and rearwardly divergent V-shaped front gauge 54 located above the plate 52. A clamp 56 is movably mounted on the wing 50 for movement towards and away from the plate 52 rearwardly of the front gauge 54 as is more clearly disclosed in patent application Ser. No. 262,665. The front gauge 54 is in the forward-rearward alignment with the back gauge 36. The plate 52 has a pair of rearwardly directed fingers 58 mounted thereto that straddle the side finger 20.

Figure 2:
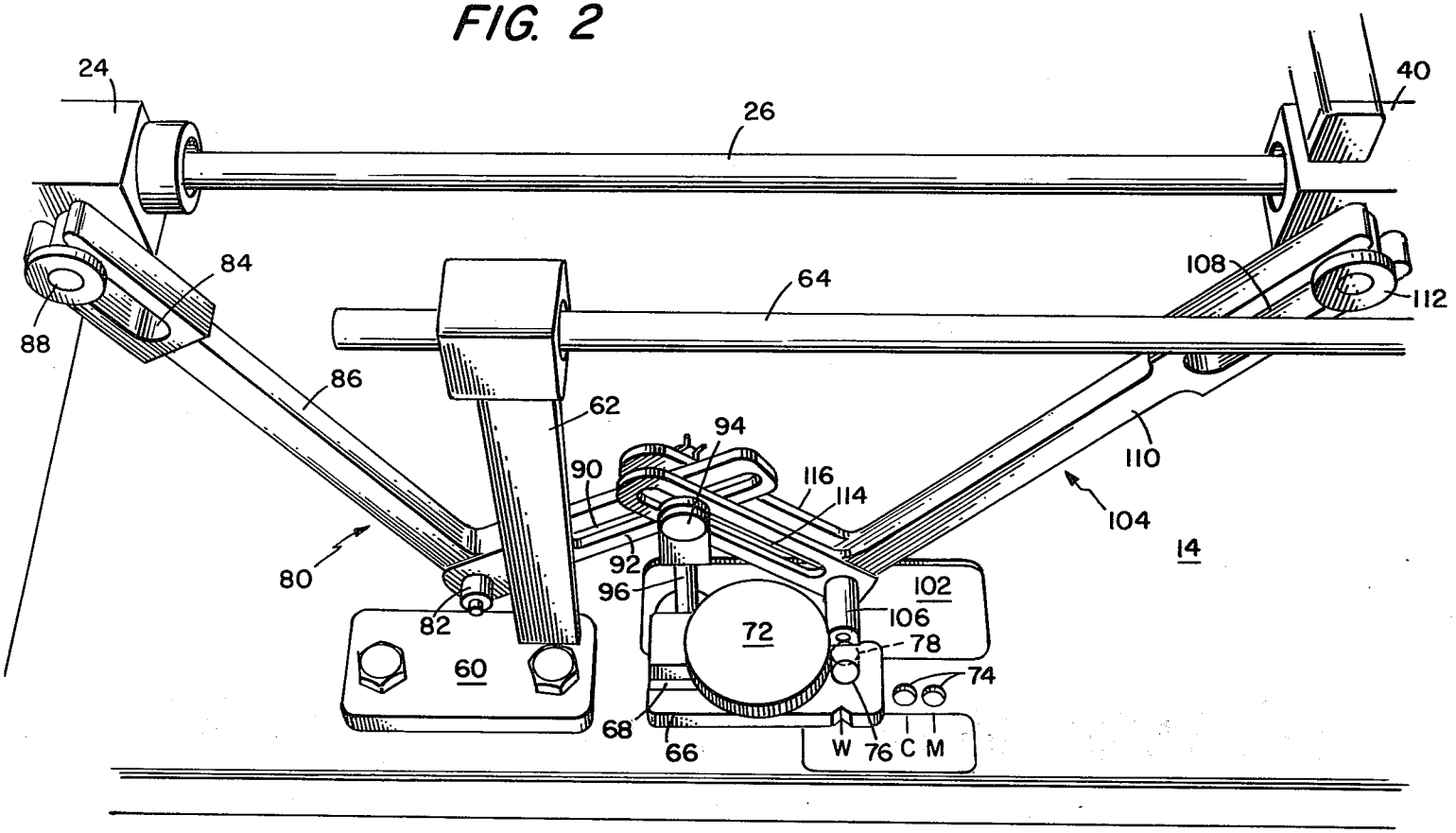
FIG. 2 is an isometric view of the gauge moving means and the adjusting means.
Figure 3:
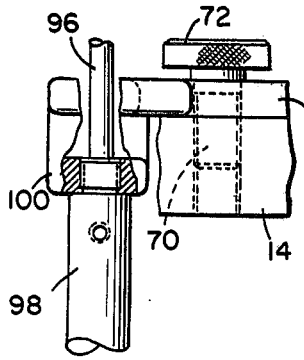
FIG. 3 is an elevation view of a part of the gauge moving means and the adjusting means.

Referring to FIGS. 1–3, a fixed plate 60 is fixedly attached to the table 14 and an upright 62 extending upwardly of the plate 60 slidably receives a guide rod 64 that is attached to the frame 40. A movable plate 66, located forwardly of the fixed plate 60, has a forwardly-rearwardly extending slot 68 that receives the shank of a screw 70 that extends through the slot 68 and is threaded into the table 14 with the head 72 of the screw 70 straddling the slot 68 and pressing against the plate 66 to thus press the plate 66 against the table 14. Thus, the plate 66 may be released for forward-rearward movement along the slot 68 by loosening the screw 70 and may be pressed against the table 14 by tightening the screw 70. A plurality of forwardly-rearwardly spaced holes 74 in the table 14 are adapted to be in alignment with a hole 76 in the plate 66 pursuant to forward-rearward movement of the plate 66 along the table 14. The hole 76 and a selected hole 74 in alignment with the hole 76 are adapted to receive a pin 78 to thereby releasably lock the plate 66 to the table 14 in the position determined by the alignment of the hole 76 with the selected hole 74.

A two armed lever 80 is pivoted to a hinge 82 that is mounted to the plate 60. A slot 84 in a rearwardly extending arm 86 of the lever 80 slidably receives a pin 88 extending from a lug 24. A slot 90 in a forwardly extending arm 92 of the lever 80 slidably receives a pin 94 mounted to a piston rod 96. As shown in FIG. 3, the piston rod 96 forms the driven element of a pneumatic motor 98 that is attached to a flange 100 depending from the plate 66 and extending through a cut-out 102 (FIG. 2) in the table 14.

A two armed lever 104 is pivoted to a hinge 106 that is mounted to the plate 66. A slot 108 in a forwardly extending arm 110 of the lever 104 slidably receives a pin 112 extending from the frame 40. A slot 114 in a rearwardly extending arm 116 of the lever 104 slidably receives the pin 94.

In the idle condition of the machine: the platform 16 is in an upper position with the fingers 18,20 substantially at the same level as the fingers 58; the piston rod 30 is projected out of the motor 28 so that the back gauge block 32 is bearing against the platform 16; the clamp 56 is upward of and spaced from the plate 52; the sub-carrier 46 is yieldably urged forwardly into engagement with the frame 40; the carrier 42 is in a forward position in engagement with the frame 40; and the piston rod 96 is projected out of the motor 98 to maintain the back gauge 36 in a relatively rearward position and the front gauge 54 in a relatively forward position by means of the connections including the levers 80 and 104 between the piston rod 96 and the gauges 36 and 54.

Figure 4:
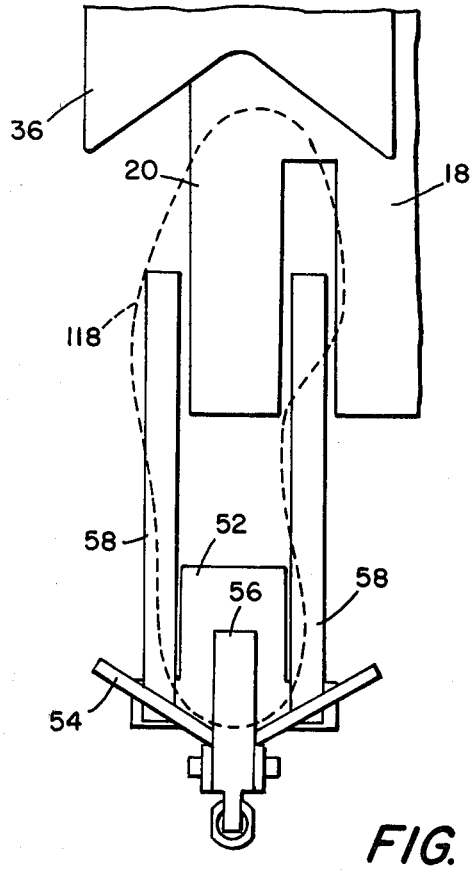
FIG. 4 is a plan representation of an insole as it appears between the front and back gauge at the beginning of a machine cycle.

As shown in FIG. 4, at the beginning of a machine cycle a flat insole 118 is deposited between the gauges 36 and 54 on the surfaces formed by the fingers 18, 20 and 58. The toe end of the insole 118 faces rearwardly. The operator now actuates the motor 98 to retract the piston rod 96 into the motor 98 under the yieldable force of pressurized air. This retraction of the piston rod 96, through the lever 104 and its connections with the piston rod 96 and the frame 40, imparts rearward movement of the frame 40 to thereby cause the frame 40, as disclosed in patent application Ser. No. 262,665, to move the sub-carrier 46, together with the front gauge block 48, rearwardly with respect to the carrier 42. This rearward movement of the sub-carrier 46 imparts corresponding rearward movement to the gauge 54 and the fingers 58. The retraction of the piston rod 96, through the lever 86 and its connections with the piston rod 96 and the lug 24, imparts forward movement of the back gauge 36 along the platform 16. For reasons that are explained below, the mountings of the levers 80 and 104 on the hinges 82 and 106 and the connections between the levers 80 and 104 to the piston rod 96, the lug 24 and the frame 40 are such that the back gauge 36 moves forwardly at a slower rate than the front gauge 54 moves rearwardly. The concomitant forward movement of the back gauge 36 and rearward movement of the front gauge 54 continues until the insole 118 is centered in and between the V-shaped gauges 36 and 54 to operate a signal that is disclosed in patent application Ser. No. 262,665.

The operation of the signal pursuant to the engagement of the gauges 36 and 54 with the insole 118, as disclosed in patent application 262,665, causes:

a. The lowering of the clamp 56 towards the plate 56 and a clamping of the heel end of the insole 118 against the plate 56 of the front gauge block 48;
b. A locking of the sub-carrier 46 relative to the carrier 42 in the position assumed by the sub-carrier 46 at the time the signal is operated;
c. An actuation of the motor 28 to raise its piston rod 30 to thereby raise the back gauge 36 and disengage it from the platform 16 and the toe end of the insole 118; and
d. An actuation of the motor 98 to project its piston rod 96 to its idle position and thereby return the frame 40 to its forward idle position and return the back gauge 36 to its rearward idle position.

The operator can now inspect the insole 118 to determine whether it is properly positioned in the machine. If it is not, he can actuate a release valve (not shown) to return the machine parts to their idle position, remove the insole, and commence the machine cycle anew. If the operator is satisfied with the position of the insole in the machine, he shifts automatic cycling valves 120 (FIG. 1.) to enable the machine to automatically go through the remainder of its cycle.

In response to the shifting of the valves 120, the platform 16 is caused to be lowered so that the lowered platform 16 no longer supports the insole 118 as disclosed in patent application Ser. No. 262,665.

After this, in the manner disclosed in patent application Ser. No. 262,665, the carrier 42 and the sub-carrier 46 are moved rearwardly a prescribed distance to thereby move the front gauge block 48, together with the insole 118 that is now clamped to the front gauge block by the clamp 56 and is now supported on the fingers 58 of the front gauge block, rearwardly a prescribed distance.

Figure 5:
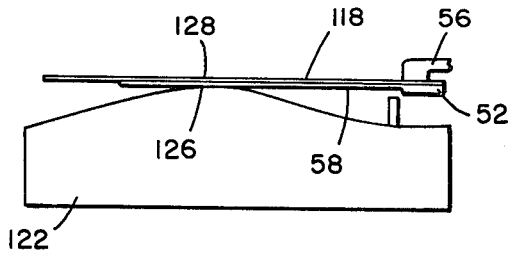
FIG. 5 is a representation of the insole as it appears in relation to the lower mold and the insole support after the insole has been transported between the molds.
Figure 6:
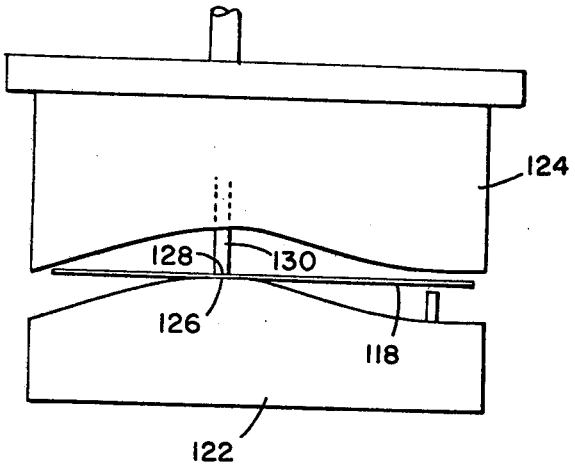
FIG. 6 is a representation of the insole as it appears between the molds prior to a molding operation of the molds on the insole.

As shown in FIG. 6, the machine includes a lower mold 122 and an upper mold 124 that are located rearwardly of the initial position of the insole 118 and are initially spaced from each other. The molds 122 and 124 have complementary molding surfaces and operate to mold a range of lengths of insoles. As shown in FIG. 5, the lower mold 122 has a ball portion 126 that separates its forepart and shank portions and is at a higher elevation than the remainder of the upper surface of the lower mold 122. At the completion of the rearward transporting of the insole 118 described in the preceding paragraph, the ball portion 128 of the insole is located directly above the ball portion 126 of the lower mold 122 for the proper operation of the below described molding operation.

To ensure that the insole ball portion 128 is directly above the lower mold ball portion 126, despite the fact that the insole 118 is transported rearwardly a prescribed distance, regardless of the length of the insole, the levers 80 and 110 are so dimensioned and pivoted to each other and to the lug 24 and the frame 40 and the hinges 82 and 106 are so located that the retraction of the piston rod 96 by the motor 98 causes the gauge 36 to move forwardly and the gauge 54 to move rearwardly at such rates that when these gauges have respectively engaged the toe and heel portions of the insole and the gauge movements are stopped, the insole ball portion 128 is at the location necessary for the insole ball portion 128 to be directly above the lower mold ball portion 126 after the insole has been rearwardly transported the prescribed distance.

In using this machine, insoles of different lengths are so constituted that there is a greater change in distances from one insole length to another insole length between the ball portions and the heel ends of the insoles than there is between the ball portions and the toe ends of the insoles. Therefore the machine is so constructed that the gauge 54 moves rearwardly at a greater rate than the gauge 36 moves forwardly. The ratios of the changes in distances, for different lengths of insoles, between the ball portions and the heel ends and between the ball portions and the toe ends is substantially a constant for each of women's insoles, children's insoles and men's insoles, but these ratios are different for women's insoles, for children's insoles, and for men's insoles. Thus, this ratio has been found to be $1\frac{3}{8}$ to 1 for women's insoles, $1\frac{3}{4}$ to 1 for children's insoles, and 2 to 1 for men's insoles. In order to compensate for these different rations, the plate 66 is loosened by the screw 70 and shifted forwardly or rearwardly along with the hinge 106 and the motor 98 until the rearmost hole 74 is in alignment with the hole 76 for women's insoles, as shown in FIG. 2, and the plate 66 is locked in this position by the pin 78. When operating on children's insoles, the center hole 74 is placed in alignment with the hole 76 and when operating on men's insoles, the forwardmost hole 74 is placed in alignment with the hole 76. These different locations of the plate 76 change the angular dispositions of the lever 104 about the axis of the hinge 106 as permitted by the slots 108 and 114 to alter the ratios of the speeds of the gauges 36 and 54 pursuant to the retraction of the piston rod 96 dependent on whether the machine is operating on women's, children's or men's insoles.

Now, as disclosed in patent application Ser. No. 262,665, the upper mold 124 is lowered to the position shown in FIG. 6 wherein the upper mold is spaced from the lower mold 122 and is disengaged from the insole 118 and piston rods 130 are caused to engage the ball portions 128 of the insole so that, when the upper mold 124 has reached the FIG. 6 position, the piston rods 130 are holding the insole 118 against the lower mold ball portion 126.

Now the clamp 56 is raised to release it from the insole 118 and the front gauge 54, the clamp 56 and the fingers 58 are returned forwardly to their idle positions while the insole 118 is held against the lower mold 122 by the piston rods 130.

Figure 7:
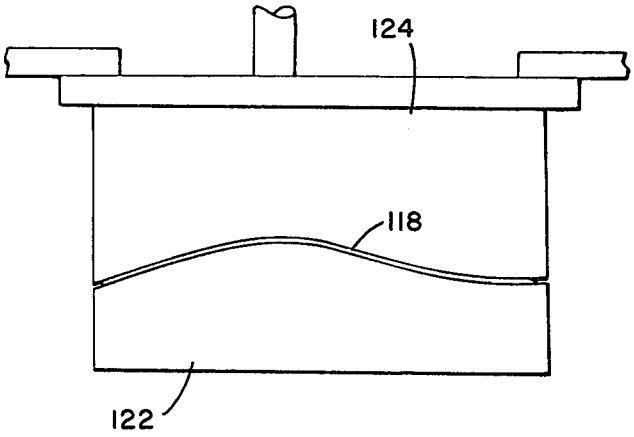
FIG. 7 is a representation of the molds performing a molding operation on the insole.

Now the piston rods 130 are raised into the upper mold 124 and the molds 122 and 124 are brought against each other, in the manner shown in patent application 262,665 and in FIG. 7, to mold the flat insole 118 to the shape of the facing complementary molding surfaces of the molds 122 and 124.

The remainder of the machine cycle is as disclosed in patent application Ser. No. 262,665. This includes raising the upper mold 124 away from the lower mold 122 with the molded insole 118 being carried upwardly with the upper mold, placing a last bottom-up beneath the upper mold, enabling the molded insole to fall from the upper mold onto the last bottom, aligning the molded insole with the last bottom, and adherently attaching the molded insole to the last bottom.

There follows a recapitulation of the description of those portions of the machine and its mode of operation that are germane to this invention.

There is provided a mechanism for so transporting a workpiece 118 rearwardly to a work station formed by the molds 122,124 that a prescribed portion (the ball portion 128) of the workpiece is in registry with a prescribed portion (the ball portions of the molds 122,124) of the work station. This mechanism comprises: the carrier 42; the front gauge 54 mounted to the carrier for forward-rearward movement; the back gauge 36, located rearwardly of the front gauge 54, mounted for forward-rearward movement; a work support formed by the plate 52 and the fingers 58 mounted to the front gauge 54 and extending towards the back gauge 36; a gauge moving means shown in FIG. 2 for moving the front gauge 54 rearwardly with respect to the carrier 46 and the back gauge 36 forwardly at different speeds until the gauges intersect the opposite ends of the workpiece 118 that is on the work support 52,58; means, shown in patent application Ser. No. 262,665, operative to lock the front gauge 54 to the carrier and to hold, by the clamp 56, the workpiece 118 on the work support 52,58; and means, shown in patent application Ser. No. 262,665, for thereafter transporting the carrier 42 rearwardly a prescribed distance to thereby transport the workpiece 118 to the work station 122,124 with said prescribed portions in registry.

The mechanism described in the preceding paragraph is improved, in accordance with this invention, by providing adjusting means, as shown in FIG. 2 and described below, for adjusting the ratios at which the gauge moving means moves the front gague 54 rearwardly and the back gauge 36 forwardly.

The gauge moving means comprises: a drive element in the form of the piston rod 96; a first two armed lever 80 pivoted by a first hinge 82 intermediate its ends having a first arm 86 operatively connected to the back gauge 36 by the pin 88 and a second arm 92 operatively connected to the drive element 96 by the pin 94; a second two armed lever 104 pivoted by a second hinge 106 intermediate its ends having a first arm 110 operatively connected to the front gauge 54 by the pin 112 and a second arm 116 operatively connected to the drive element 96 by the pin 94; and means 98 for moving the drive element 96 to thereby move each of the second arms 92 and 116 and thus move the front gauge 54 and the back gauge 36 as aforesaid. The adjusting means comprises: means, formed by the pin 78 engaging a selected hole 74, for adjusting the distance between one of the hinges (the hinge 106) and the operative connection (112) between its associated first arm (110) and its associated gauge (54).

The adjusting means further comprises: the table 14, the plate 66 movably mounted on the table for forward-rearward movement; means, formed by the pin 78 and a selected hole 74, for locking the plate 66 to the table 14 in a selected one of different forward-rearward adjusted positions of the plate on the table; the hinge 106 mounted to the plate 66 for movement therewith; and the drive element 96 mounted to the plate 66 by the motor 98 and the flange 100 for movement therewith.

I claim:

1. A mechanism for so transporting a workpiece rearwardly to a work station that a prescribed portion of the workpiece is in registry with a prescribed portion of the work station comprising: a carrier; a front gauge mounted to the carrier for forward-rearward movement; a back gauge, located rearwardly of the front gauge, mounted for forward-rearward movement; a work support mounted to the front gauge and extending rearwardly towards the back gauge; gauge moving means for moving the front gauge rearwardly with respect to the carrier and the back gauge forwardly at different speeds until the gauges intersect the opposite ends of the workpiece that is on the work support; means, operative after the intersection of the gauges with the opposite ends of the workpiece, to lock the front gauge to the carrier and to hold the workpiece on the work support; and means for thereafter transporting the carrier rearwardly a prescribed distance to thereby transport the workpiece to the work station with said prescribed portions in registry; characterized in that said gauge moving means comprises: adjusting means for adjusting the ratios at which the gauge moving means moves the front gauge rearwardly and the back gauge forwardly.

2. The mechanism according to claim 1 wherein the gauge moving means comprises: a drive element; a first two armed lever pivoted by a first hinge intermediate its ends having a first arm operatively connected to the back gauge and a second arm operatively connected to the drive element; a second two armed lever pivoted by a second hinge intermediate its ends having a first arm operatively connected to the front gauge and a second arm operatively connected to the drive element; and means for moving the drive element to thereby move each of the second arms and thus move the front gauge and the back gauge as aforesaid; and characterized in that said adjusting means comprises: means for adjusting the distance between one of said hinges and the operative connection between its associated first arm and its associated gauge.

3. The mechanism according to claim 2 characterized in that said adjusting means comprises: a table; a plate movably mounted on the table for forward-rearward movement; means for locking the plate to the table in a selected one of different forward-rearward adjusted positions of the plate on the table; means mounting side one of said hinges to said plate for movement therewith; and means mounting the drive element to said plate for movement therewith.

* * * * *